US008025177B2

(12) United States Patent
Bruno et al.

(10) Patent No.: US 8,025,177 B2
(45) Date of Patent: Sep. 27, 2011

(54) JOINT COMPOUND CONTAINER

(75) Inventors: Robert Bruno, Avon, CT (US); Matthew Earle Myers, Naperville, IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 12/607,135

(22) Filed: Oct. 28, 2009

(65) Prior Publication Data

US 2010/0044384 A1 Feb. 25, 2010

Related U.S. Application Data

(63) Continuation of application No. 11/479,212, filed on Jun. 30, 2006.

(51) Int. Cl.
*B65D 25/00* (2006.01)
*B65D 90/00* (2006.01)

(52) U.S. Cl. ..... 220/695; 220/640; 220/700

(58) Field of Classification Search ..... 220/639, 220/640, 642, 659, 695, 698, 700; 294/3.5
See application file for complete search history.

(56) References Cited

U.S. PATENT DOCUMENTS

| | | | | |
|---|---|---|---|---|
| 236,518 | A | | 1/1881 | Vivarttas |
| 1,385,602 | A | * | 7/1921 | Bentley ..... 220/640 |
| 4,664,347 | A | | 5/1987 | Brown et al. |
| 5,603,428 | A | | 2/1997 | Breckwoldt |
| 6,006,936 | A | | 12/1999 | Przybylowicz |
| 6,454,124 | B1 | | 9/2002 | Edwards et al. |
| 6,637,792 | B1 | | 10/2003 | McCoy et al. |
| 2003/0015532 | A1 | | 1/2003 | Rickman et al. |
| 2003/0034349 | A1 | | 2/2003 | Frey |

* cited by examiner

*Primary Examiner* — Harry Grosso
(74) *Attorney, Agent, or Firm* — Greer, Burns & Crain, Ltd.

(57) ABSTRACT

A joint compound container including a body having a generally trough shape formed from two opposing planar side walls separated from one another by a planar floor, and opposing end walls. The container also includes a reinforcing band attached to the body and configured for reinforcing each of the side walls and the end walls where the reinforcing band is displaced from an upper edge of the body only by a distance sufficient to define a scraping edge extending upwardly beyond an upper edge of the reinforcing band and where the scraping edge is formed by the upper edge of the body and supported by the band.

7 Claims, 3 Drawing Sheets

JOINT COMPOUND CONTAINER

PRIORITY CLAIM

This application is a continuation application of and claims the benefit of U.S. patent application Ser. No. 11/479,212 filed on Jun. 30, 2006, which is herein incorporated by reference.

BACKGROUND

The present invention relates generally to containers, and more specifically to hand-held containers used to hold joint compound, which is used in wallboard construction.

Joint compound containers, also known as mud pans, are available in various sizes, and are used to provide workers with easy access to the joint compound necessary for wallboard construction projects. Workers generally carry a container in one hand, and a taping knife in the other. In this way, a worker can use the knife both to remove joint compound from the container and to mix the compound as necessary. As part of the mixing process, workers often rotate, or "flip" the joint compound container in their hand to mix the compound from a different angle. In this flipping motion, the container is rotated approximately 180° about an axis of rotation. Workers routinely use the side wall of the container to scrape excess joint compound from their taping knife before applying the compound to the wallboard, or as part of the mixing process.

There are two general shapes for joint compound containers currently on the market: those with a generally "U"-shaped profile when viewed from an end, and those with a generally trapezoidal profile. Both of these shapes present problems to wallboard installers. For example, both container shapes are designed to be held by an adult male with average-sized hands. A worker with smaller than average hands will often find it difficult and uncomfortable to use such a container for an extended period of time.

The "U"-shaped container is relatively more comfortable to grip for long periods of time than the trapezoidal container, but the lack of a flat bottom may prevent workers from adequately mixing the joint compound. Additionally, the "U"-shaped container is unstable if placed on a floor, table, or other substrate. U.S. Pat. Nos. 5,603,428 and 6,454,124 disclose examples of such U-shaped containers having bases or end caps with feet for more stability on a substrate. However, the addition of stability has not cured the above-identified mixing problems of this design.

Conversely, the trapezoidal joint compound container is stable when placed on a substrate, but its sharp, angular edges and wide bottom make the container uncomfortable to hold for long periods of time. Angular edges also impair complete mixing of the joint compound. Joint compound is known to become stuck along the edges and is not dislodged by the worker's normal mixing stroke, which wastes some of the joint compound. The angular edges also make the trapezoidal container difficult to clean, due to setting of material remaining along the edges where the floor meets the side wall, making it more difficult to remove and also wasting material. The angular corners and edges of this type of container can also act as "catch points" in that they have been known to catch on a worker's clothing or skin and cause the worker to drop the container, particularly when flipping or rotating it.

Additionally, both shapes of conventional mud pans have problems with deformation over time. The containers are generally made from metal, such as stainless steel to provide durability and to facilitate cleaning. Using metal prevents problems such as cracking when dropped, but such drops may deform these containers. Further, workers repeatedly draw their taping knives across the top edge of the joint compound container to regulate the amount of joint compound on the taping knife. Over time, pulling the knife across the relatively long side wall deforms or causes an unequal bowing of the side wall. This unequal bowing makes it difficult for workers to properly mix the joint compound in the container and/or control the amount and distribution of joint compound on the taping knife.

Consequently, the construction, home repair, and home decorating industries, as well as do-it-yourself workers have long felt the need for an improved joint compound container that provides a comfortable grip, a container in which joint compound can be adequately and more thoroughly mixed, and a container that will resist deformation, yet remain durable and easy to clean.

SUMMARY

A joint compound container is provided which responds to the above-identified needs felt by construction and home repair professionals, as well as do-it-yourself workers. The container, available in multiple lengths, such as 10 inch (254 mm), 12 inch (305 mm), and 14 inch (356 mm), has side walls that are connected to the floor via a corner-free edge. This makes mixing and cleaning easier because it reduces the crevices where joint compound can collect and dry. Removing the creased edge also helps to stop the container from catching on a worker's skin or clothing when "flipping" it. The shape of the container is also more ergonomic. The floor of the container is substantially narrower than the top opening, which makes the container more comfortable to hold for those with smaller hands, while providing comfort to users with a relatively wide range of hand sizes.

The container also includes a reinforcing band, displaced slightly from the upper edge of the side walls to function as a scraping edge. The reinforcing band helps prevent the unequal bowing of the side walls generated from extended use, and also strengthens the container to help prevent deformation in the event that it is dropped.

More specifically, the present joint compound container has two opposing end walls, and a generally trough-shaped body formed from two planar side walls separated from one another by a planar floor. The body is affixed to the end walls. Each of the side walls shares a respective common radiused edge with the floor of the container.

In another embodiment, the present container has two opposing end walls, and a generally trough-shaped body formed from two planar side walls separated from one another by a planar floor and affixed to the end walls, and a reinforcing band is attached to the container. The band reinforces each of the side walls and end walls, and is displaced a distance from the upper container edge sufficient to define a scraping edge.

In a third embodiment, the container has two opposing end walls and a body having a generally trough shape formed from two planar side walls attached to a planar floor via a corner-free shared edge, and also attached to the end walls. Each of the side walls and the end walls forms an obtuse angle with respect to said floor. The side walls and end walls have a substantially thicker portion near an upper edge of the walls, and each side wall has a scraping edge adjacent to its upper edge.

DETAILED DESCRIPTION

Figures 1, 2:
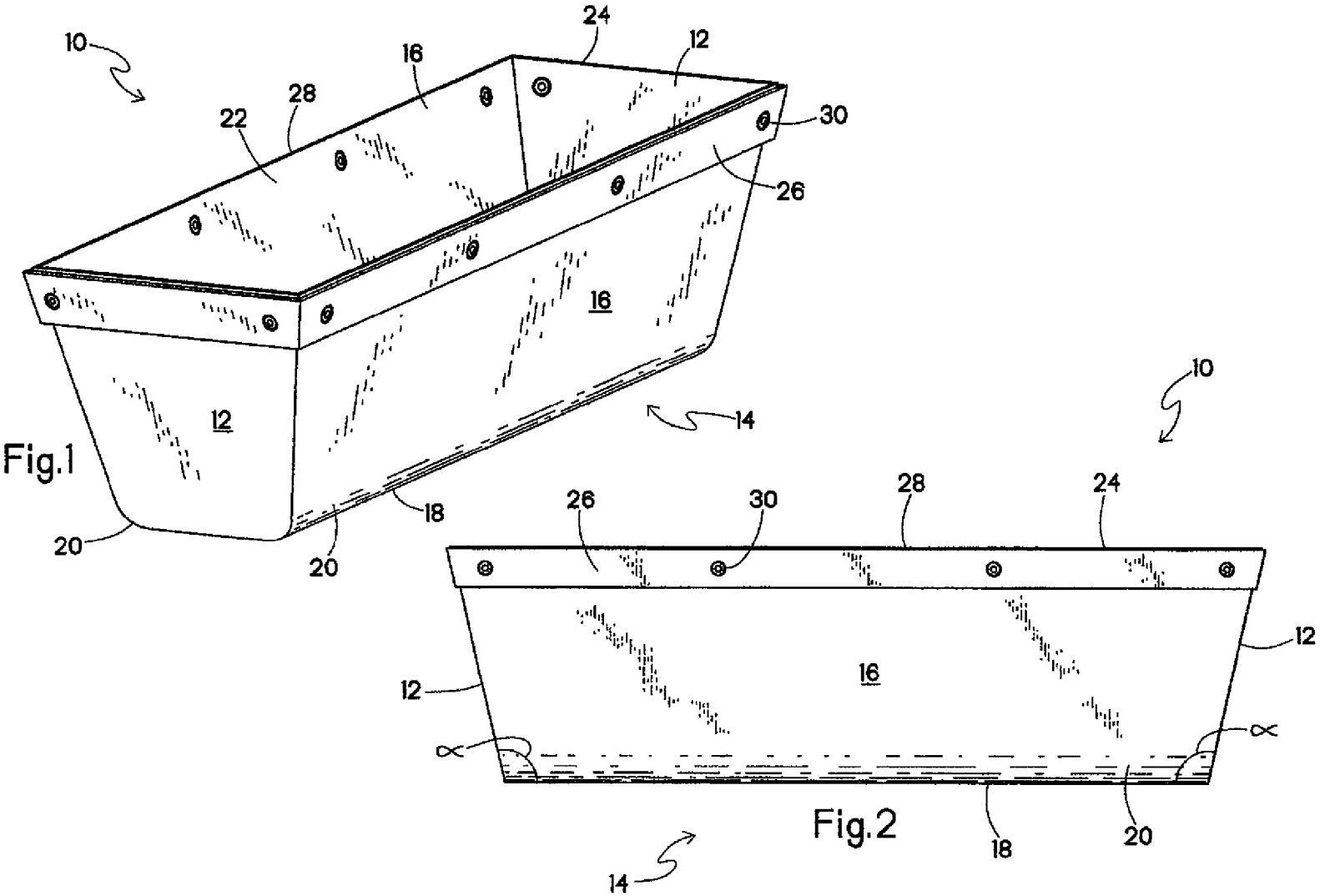
FIG. 1 is a top perspective view of the present joint compound container.
FIG. 2 is a side elevation of the container of FIG. 1.

Referring now to FIGS. 1-4, a joint compound container is generally designated 10. Generally made up of opposing end walls 12 and a unitary body portion 14 made up of two generally planar side walls 16 and a planar floor 18, the container 10 has a generally trough shape. The container 10 is preferably constructed from stainless steel, but other materials are contemplated.

Positioned at opposite ends of the body 14, the end walls 12 are affixed to the body through conventional processes include welding, being integrally molded, fasteners, tabs and slots, or any similar fastening technique. As can be seen in FIG. 2, the end walls 12 diverge upwardly from the floor 18, forming an obtuse angle $\alpha$ with respect to the floor.

Figure 4:
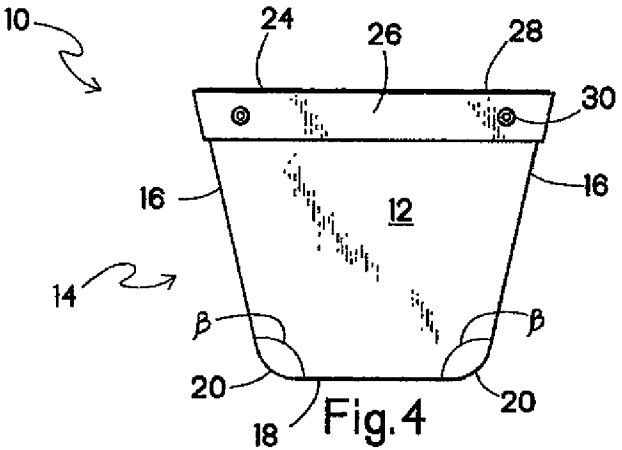
FIG. 4 is an end elevation of the container of FIG. 1.
Figure 6:
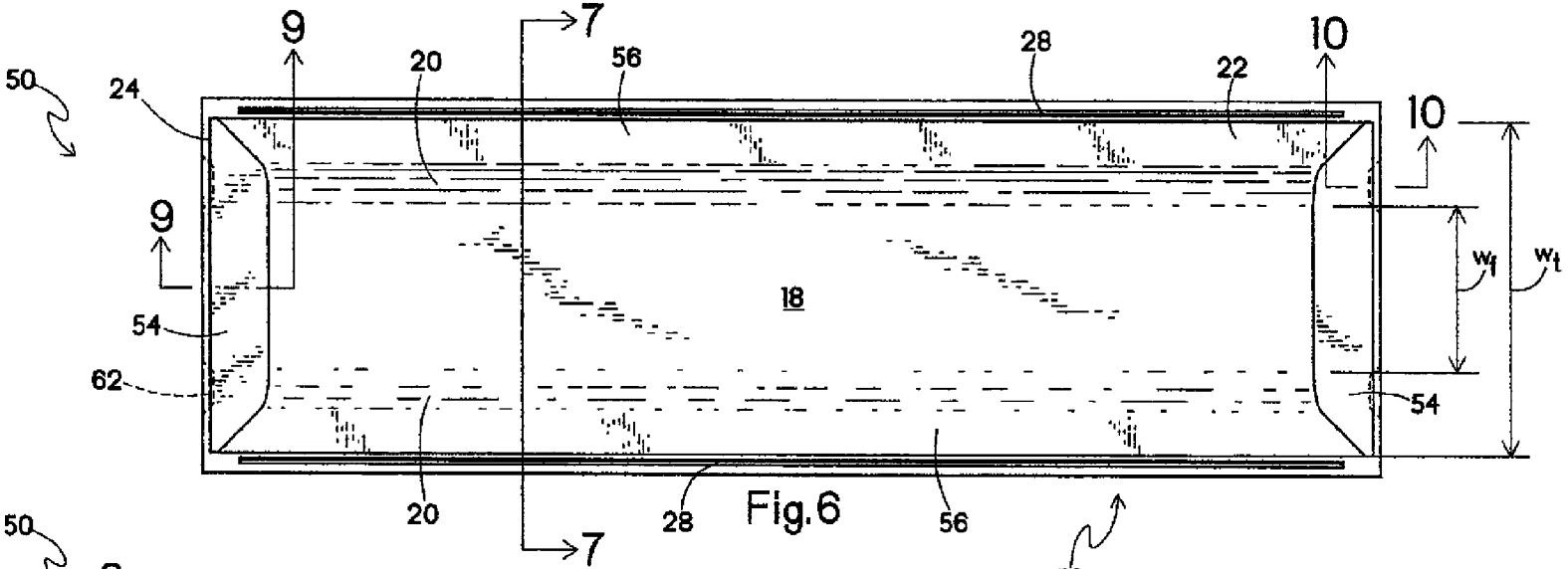
FIG. 6 is an overhead plan view of another alternate embodiment of the present joint compound container.
Figure 10:
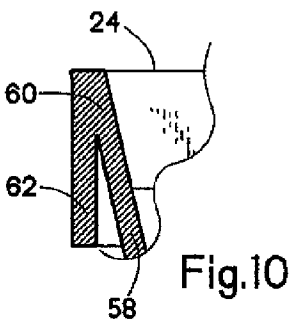
FIG. 10 is a fragmentary vertical cross-section of the container of FIG. 6, taken along the line 10-10 in the direction generally indicated.
Figure 9:
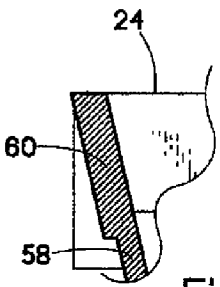
FIG. 9 is a fragmentary vertical cross-section of the container of FIG. 6, taken along the line 9-9 in the direction generally indicated.
Figure 8:
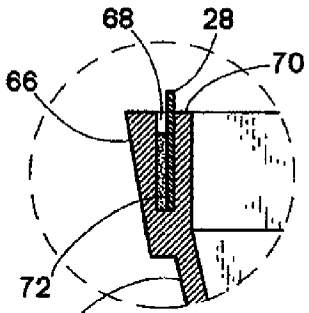
FIG. 8 is a fragmentary vertical cross-section of the container of FIG. 7, taken from zone 8 as indicated.
Figure 7:
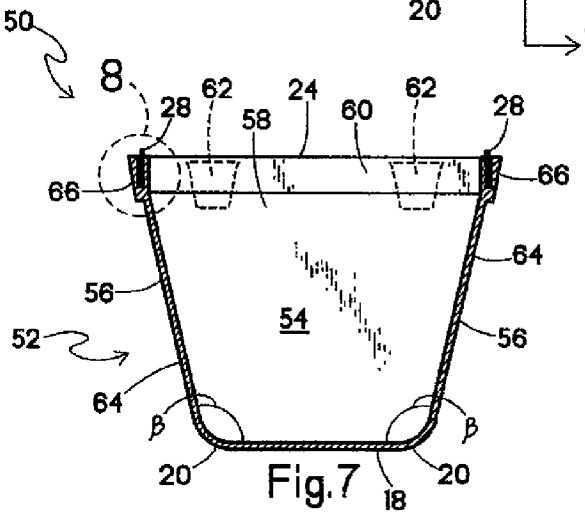
FIG. 7 is a vertical cross-section view of the container of FIG. 6, taken along the line 7-7 in the direction generally indicated.

As is best seen in FIG. 4, each of the side walls 16 shares a respective common radiused edge 20 with the floor 18. That is, the preferred steel, other metal or other material used to form the body 14 is not creased to form an edge between the floor 18 and the side wall 16. Rather, the material is rolled or otherwise formed to produce an arcuate transition between the floor 18 and the side wall 16. Further, the radiused edge 20 defines an obtuse angle $\beta$, preferably between about 102° and 104°, between the side wall 16 and the floor 18.

An important feature of this configuration is that it alleviates difficulty in mixing joint compound. The radiused edges 20 prevent build up or premature setting of joint compound and allow workers to dislodge all material with a natural mixing stroke, adding to overall comfort for the workers, as well as facilitating more efficient utilization of the joint compound. Similarly, the radiused edges 20 facilitate cleaning the container 10.

Figure 3:
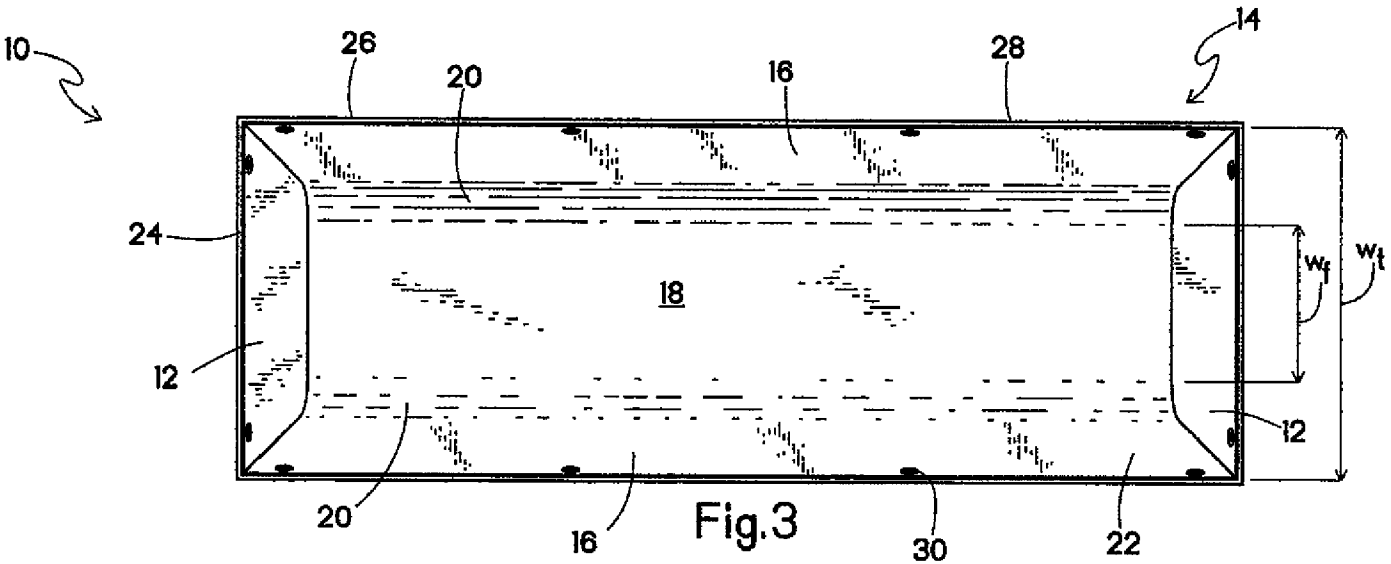
FIG. 3 is an overhead plan view of the container of FIG. 1.

Also, as can best be seen in FIG. 3, a top opening 22 is defined by an upper edge 24 of the container 10. Because of the obtuse angles $\beta$ formed between the floor 18 and side walls 16, a width of the floor $w_f$ is significantly less than a width of the top opening $w_t$. Specifically, the ratio $w_f/w_t$ for this embodiment is preferably in the general range of 0.55 to 0.65. It has been found that with this configuration the top opening is large enough for a worker to use the container 10 with a natural motion, and also that the floor 18 of the container will be narrow enough to be comfortably held by workers with smaller than average hands and/or over extended periods of use. However, other ratios are contemplated for obtaining the same results.

Additionally, as can be seen in FIGS. 1-4, a reinforcing band 26 is preferably attached to the container 10, adjacent to the upper edge 24 of the container, and displaced from the upper edge a distance sufficient to define a scraping edge 28. The band 26 is attached to the container 10 by rivets 30, spot welding, or any similar fastening technology. The band 26 is constructed of a rigid, durable material, such as steel or equivalent materials, and is positioned to reinforce the end walls 12, and the side walls 16, as well as provide general structural support for the container 10. In particular, the band 26 helps to prevent bowing of the side walls 16 from repeated scraping of an applicator tool, such as a taping knife, across the scraping edge 28.

Figure 5:
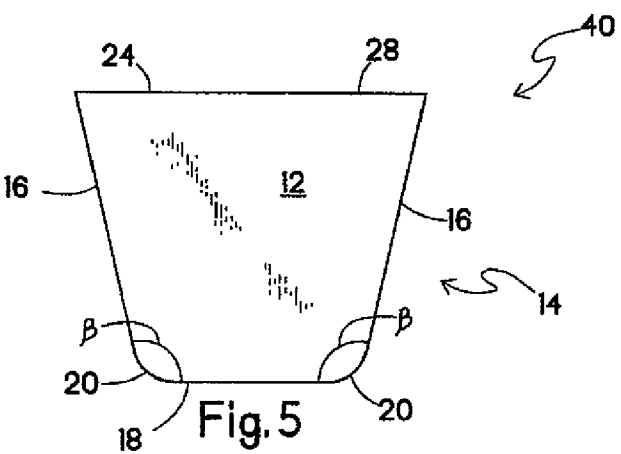
FIG. 5 is an end elevation of an alternate embodiment of the present joint compound container.

Another embodiment of the joint compound container, generally designated 40, is seen in FIG. 5. Components shared with container 10 are designated with identical reference numbers. The container 40 includes the respective common radiused edge 20 shared by the floor 18 and the side walls 16. This facilitates the mixing and cleaning processes as described above. However, the container 40 lacks the reinforcing band 26. This is the principal difference between the containers 10 and 40.

A third embodiment of the present joint compound container, generally designated 50, is shown in FIGS. 6-10. Components shared with containers 10 and 40 are designated with identical reference numbers. In the third embodiment, the container 50 is made up of a unitary body 52, which has two opposing end walls 54, two planar side walls 56 and a planar floor 18, together describing a generally trough shape as in the first two embodiments. This embodiment is preferably made from a plastic selected for its light weight, durability, low cost, and/or ease of use. The container 50 is preferably integrally molded as is known in the art, but may also be fabricated using chemical adhesive, ultrasonic welding, or the like.

The end walls 54 have a lower portion 58 and an upper portion 60, where the upper portion is substantially thicker than the lower portion to enhance the rigidity of the container 50. Stacking tabs 62 (FIG. 10) are attached to, and depend from, the upper portion 60 of the end walls 54. An advantage of the stacking tabs 62 is to maintain an air gap between multiple containers 50 when the containers are vertically stacked, as during bulk shipment. The end walls 54 diverge upwardly from the floor 18, so that each end wall forms the respective obtuse angle $\alpha$ with the floor.

Each side wall 56 has a lower portion 64 and an upper portion 66. The upper portion 66 is substantially thicker than the lower portion 64. This added thickness helps increase the overall rigidity of the container 50. The side walls 56 are connected to the end walls 54 and the floor 18 by integral molding, chemical adhesive, or the like as described above.

Additionally, the upper portion 66 of the side walls 56 includes a mounting groove 68 positioned laterally along the upper edge 70 of the side wall. Mounted within the mounting groove 68, secured by mounting substance 72 and extending generally vertically upward is a scraping edge 28. The mounting substance 72 may be a chemical adhesive, plastic used for insert molding, or the like. The scraping edge 28 is made from a metal, such as stainless steel, and may either be sharpened or left dull.

The lower portion 64 of each side wall 56 shares a respective corner-free radiused edge 20 with the floor 18. Each radiused edge 20 describes an obtuse angle $\beta$, preferably between 102° and 104°, between its respective side wall 56 and the floor 18.

Also, a top opening 22 is defined by an upper edge 24 of the container 50. Because of the obtuse angles $\beta$ formed between the floor 18 and side walls 56, a width of the floor $w_f$ is significantly less than a width of the top opening $w_t$. Specifically, the ratio $w_f/w_t$ for this embodiment is preferably between 0.65 and 0.75; however ratios in the general range of 0.55 to 0.75 are contemplated for this embodiment, as well as for the embodiment of FIGS. 1-5. It has been found that with this configuration the top opening is large enough for a worker to use the container 50 with a natural motion, and also that the floor 18 of the container will be narrow enough to be comfortably held by workers with smaller than average hands and/or over extended periods of use.

In summary, the present joint compound container has side walls which are connected to the floor via corner-free shared edges that facilitate mixing and cleaning by reducing crevices where joint compound can collect and set. The container is also more ergonomic, having a relatively narrow floor, and a relatively wide top opening, which allows workers with a wide range of hand sizes to hold the container comfortably for long periods of time, while still allowing for a natural motion when removing or mixing joint compound. Finally, the reinforcing band lends strength and rigidity to the container, and helps prevent unequal bowing of the side wall from extended use, and also helps prevent deformation if the container is dropped.

While particular embodiments of the present joint compound container have been described herein, it will be appreciated by those skilled in the art that changes and modifications may be made thereto without departing from the invention in its broader aspects and as set forth in the following claims.

The invention claimed is:

1. A joint compound container comprising:

a body having a generally trough shape formed from two opposing planar side walls separated from one another by a planar floor, and opposing end walls;

a reinforcing band fixedly attached to said body and configured for reinforcing each of said side walls and said end walls, said band having a designated width; and said reinforcing band is displaced from an upper edge of said body only by a distance sufficient to define a scraping edge extending upwardly beyond an upper edge of said reinforcing band, said scraping edge formed by said upper edge of said body and being supported by said band, said distance being less than said designated width of said band.

2. The container according to claim 1, wherein said body is unitary.

3. The container according to claim 1, wherein each of said side walls shares a respective common radiused edge with said floor.

4. The container according to claim 3, wherein said radiused edge defines an angle of approximately 102°-104°.

5. The container according to claim 1, wherein said reinforcing band is attached to said body by a plurality of fasteners.

6. The container according to claim 1, wherein each of said side walls and said end walls forms an obtuse angle relative to said floor.

7. The container according to claim 1, wherein a ratio between a cross-sectional width of said floor and a cross-sectional width of a top opening defined by an upper edge of said side walls and said end walls is generally between 0.55 and 0.65.

* * * * *